US009676594B2

(12) United States Patent
Marshall

(10) Patent No.: US 9,676,594 B2
(45) Date of Patent: Jun. 13, 2017

(54) ANTI-ROTATION SYSTEM AND ANTI-ROTATION DEVICE

(71) Applicant: Jesse D. Marshall, Las Vegas, NV (US)

(72) Inventor: Jesse D. Marshall, Las Vegas, NV (US)

(73) Assignee: LML LIFTS, LLC, Las Vegas, NV (US)

( * ) Notice: Subject to any disclaimer, the term of this patent is extended or adjusted under 35 U.S.C. 154(b) by 414 days.

(21) Appl. No.: 14/472,173

(22) Filed: Aug. 28, 2014

(65) Prior Publication Data

US 2015/0060214 A1 Mar. 5, 2015

Related U.S. Application Data

(60) Provisional application No. 61/870,911, filed on Aug. 28, 2013.

(51) Int. Cl.
*B66B 7/08* (2006.01)
*B66B 7/06* (2006.01)

(52) U.S. Cl.
CPC ..... *B66B 7/08* (2013.01); *B66B 7/06* (2013.01); *Y10T 403/4631* (2015.01)

(58) Field of Classification Search
CPC .. B66B 7/085; B66B 7/08; B66B 7/06; B66B 7/10
See application file for complete search history.

(56) References Cited

U.S. PATENT DOCUMENTS

| | | | | | |
|---|---|---|---|---|---|
| 1,852,155 | A * | 4/1932 | Evans | B66B 7/10 | 187/412 |
| 1,947,708 | A * | 2/1934 | Frost | B66B 7/10 | 187/412 |
| 1,963,706 | A * | 6/1934 | La Neve | B66B 7/10 | 187/412 |
| 1,964,982 | A * | 7/1934 | Frost | B66B 7/10 | 187/412 |
| 1,973,850 | A * | 9/1934 | Evans | B66B 7/10 | 187/412 |
| 2,322,774 | A * | 6/1943 | Polack | B66B 7/10 | 187/254 |
| 5,878,847 | A * | 3/1999 | Mustalahti | B66B 7/02 | 187/266 |
| 6,123,176 | A * | 9/2000 | O'Donnell | B66B 7/10 | 187/393 |
| 2006/0260879 | A1* | 11/2006 | Fischer | B66B 11/00 | 187/266 |

* cited by examiner

*Primary Examiner* — William E Dondero
*Assistant Examiner* — Diem Tran
(74) *Attorney, Agent, or Firm* — Weide & Miller, Ltd.

(57) ABSTRACT

An anti-rotation system for an elevator system that includes an elevator shaft, elevator suspension cables, and a mechanical room includes a hitch plate disposed on a floor of the mechanical room and at a top of the elevator shaft, a plurality of cable shackles, each cable shackle including a cable locking mechanism on a first end thereof configured to lock one of the elevator suspension cables and a threaded rod on a second end thereof configured to extend through the hitch plate from the elevator shaft to the mechanical room, and a plurality of anti-rotation devices, each anti-rotation device being fixed to the threaded rod of one of the plurality of cable shackles in the mechanical room, and each anti-rotation device being connected to at least one other anti-rotation device, whereby rotation of cable shackles is prevented.

9 Claims, 5 Drawing Sheets

ANTI-ROTATION SYSTEM AND ANTI-ROTATION DEVICE

PRIORITY CLAIM

This application claims priority to and the benefit of U.S. Provisional Patent Application No. 61/870,911 filed Aug. 28, 2013 entitled Elevator Suspension Rope Anti-Rotation Device.

BACKGROUND

1. Field

The disclosed embodiments relate to elevator systems. More specifically, the disclosed embodiments relate to anti-rotation systems and devices for elevator systems.

2. Related Art

Elevator operation, construction, and maintenance is governed by numerous safety codes and rules. One such code is ANSI A17.1, *Safety Code for Elevators and Escalators*. In section 2.20.9.8, this code states that "means shall be provided to prevent the rotation of the suspension ropes without restricting their movement horizontally or vertically." These means are typically known as anti-rotation systems.

A typical anti-rotation system will be explained in a 2:1 elevator cable configuration. FIG. 1 schematically shows a 2:1 elevator cable configuration. The 2:1 elevator cable configuration 100 includes an elevator carriage 110 and a counterweight 120. The elevator carriage 110 and the counterweight 120 are suspended from elevator cables 130, such as steel or composite wound cables.

The cables 130 are each fixed to a cable shackle 140. The cable shackles 140 are configured to extend through and be affixed to a hitch plate 150, 152 disposed on a machine room floor 160. As shown in FIG. 1, a driving motor 170 using the cables 130 and a system of pulleys raises and lowers the carriage 110. It is noted that although the schematic shown in FIG. 1 shows a single cable 130 for simplicity in explanation, such elevator configurations typically comprise a plurality of cables, such as six or more cables.

Typically, the anti-rotation system is implemented as a part of the cable shackles 140. FIG. 2 schematically shows an example of a conventional anti-rotation system. As shown in FIG. 2, the cable shackles 140 include a cable locking mechanism 220 and a threaded rod 210.

The threaded rod 210 extends up from the cable locking portion 220 through the hitch plate 150. The threaded rod 210 is adjusted to an appropriate height by way of, for example, locking nuts (not shown). As a safety precaution, the threaded rod 210 often includes a transverse hole near its top end that is configured to receive a cotter pin (not shown) above the locking nuts.

The cable locking mechanism 220 receives an end of the cable 130. The cable 130 is reversed within the cable locking mechanism 220 and is configured to be wedged therein, locking the cable 130 in place. The cable locking mechanism 220 further includes an aperture 230. The aperture 230 is configured to receive a separate steel cable 240. The cable shackles 140, apertures 230, and the separate steel cable 240 define the conventional anti-rotation system.

Specifically, the steel cable 240 is threaded through each aperture 230 in each cable locking mechanism 220 suspended from the hitch plate 150. Ends of the steel cable 240 are then fastened together with a cable clamp 250 or the like. In this manner, if one of the shackles begins to rotate, the cable 240 will limit the rotation due to the cable 240 being threaded through each of the cable shackles 140.

While the anti-rotation system described above may effectively prevent rotation of the cable shackles, there are a number of drawbacks with the conventional anti-rotation system. As one drawback, as shown in FIGS. 1 and 2, the conventional anti-rotation system is built into the cable shackles 140 and is thus disposed below the hitch plates 150 and 152. That is, the conventional anti-rotation system is disposed within the elevator shaft, and, more specifically, is disposed near the upper end of the elevator shaft. This makes maintenance of the anti-rotation system or other components requiring the removal of the anti-rotation system dangerous and cumbersome to a maintenance person.

For example, during use over time, the cable 240 may become pinched or broken from the shackles 140 trying to rotate, and the cable may need to be replaced. Further, other maintenance or adjustments to the cables 130 or cable shackles 140 may need to take place, requiring removal and replacement of the cable 240 of the anti-rotation system.

However, because the cable 240 is at the top of the elevator shaft and is below the machine room floor 160 and hitch plates 150 and 152, the cable 240 is only accessible through the elevator shaft. Furthermore, in some elevator cable configurations, there may be a substantial amount of clearance, such as twenty feet or more, between the top of the carriage 110 or other platform and where the conventional anti-rotation device is located. As a result, the maintenance person must use an extension ladder on top of the elevator carriage 110 and install safety lines to gain access to the cable shackles 140 and the anti-rotation system. The cable shackles are further in a tight configuration that makes it difficult to remove and install the cable 240, especially when working high up on a ladder that is situated on the top of the elevator carriage 110.

As a result, the prior art design adds to the complexity and time it takes to install or adjust and maintain the elevator cables. This results in additional labor costs. In addition, it places the elevator operator at risk since they must be suspended out over the open elevator shaft to install or adjust the anti-rotation devices on the shackles.

Furthermore, the numerous cables and shackles are in close proximity near the top of the shaft by but under the shift plate 150, 152. To thread the cable through the shackle, while suspended on a ladder, over the open elevator shaft, requires that the elevator technician rotate the cables to align the openings in the shackles to allow the anti-rotation cable 240 through the shackle opening. This is very difficult because the weight of the elevator is suspended by the cable and the cable is very stiff and of a large diameter. As can be appreciated, this aspect of elevator installation and maintenance is a significant drawback.

Accordingly, there is a need for an anti-rotation system that prevents rotation of the shackles while being easily and safely accessed by a maintenance person.

SUMMARY

The disclosed embodiments have been developed in light of the above problems and aspects of the invention may include an anti-rotation system for an elevator system that includes an elevator shaft, elevator suspension cables, and a mechanical room. The anti-rotation system may comprise a hitch plate disposed on a floor of the mechanical room and at a top of the elevator shaft and a plurality of cable shackles. Each cable shackle may include a cable locking mechanism on a first end thereof configured to lock one of the elevator suspension cables and a threaded rod on a second end thereof configured to extend through the hitch plate from the elevator shaft to the mechanical room.

The anti-rotation system may further comprise a plurality of anti-rotation devices. Each anti-rotation device may be fixed to the threaded rod of one of the plurality of cable shackles in the mechanical room, and each anti-rotation device may be connected to at least one other anti-rotation device, whereby rotation of cable shackles is prevented.

According to other aspects of the invention, each anti-rotation device may be comprised of a cylindrical body having a first end and a second end. The first end may comprise a bore that extends partially through the cylindrical body, the bore being configured to receive the threaded rod.

Each anti-rotation device may further comprise a first aperture that extends through the cylindrical body in a direction perpendicular to an axis defined by the cylindrical body. Each anti-rotation device may also comprise a second aperture that extends through the cylindrical body in a direction perpendicular to an axis defined by the cylindrical body, the second aperture intersecting the bore.

The threaded rod may comprise a transverse hole, and the anti-rotation system may further comprise a bolt that is configured to extend through the second aperture of the anti-rotation device and the transverse hole of the threaded rod. The plurality of anti-rotation devices may be tied together by a cable. For example, the cable may be threaded through the first aperture of each of the anti-rotation devices, and ends of the cable may be fixed together with a cable clamp.

According to other aspects of the invention, an anti-rotation device may comprise a cylindrical body with a planar first end and a planar second end. A bore may be disposed in the first end of the cylindrical body, the bore extending partially through the cylindrical body. A first aperture may extend through the cylindrical body in a direction perpendicular to an axis defined by the cylindrical body, and at least one second aperture may extend through the cylindrical body in a direction perpendicular to the axis. The at least one second aperture may intersect the bore, and a bolt may extend through the at least one second aperture.

According to other aspects of the invention, the anti-rotation device may be configured to be connected at least one other anti-rotation device via the first aperture. The connection between the anti-rotation device and the at least one other anti-rotation device may prevent rotation of the anti-rotation device.

The first aperture may have an inner surface that is smooth and is configured to receive a cable to connect the anti-rotation device with the at least one other anti-rotation device. The inner surface of the first aperture may alternatively be threaded. An inner surface of the bore may be threaded whereby the bore is configured to be threaded onto a threaded rod of an elevator cable shackle. Alternatively, the inner surface of the bore may be smooth whereby the bore is configured to slide over and onto a threaded rod of an elevator cable shackle. The bolt may be at least partially threaded, and the bolt may be configured to pass through a transverse hole in a threaded rod of an elevator cable shackle.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 3:
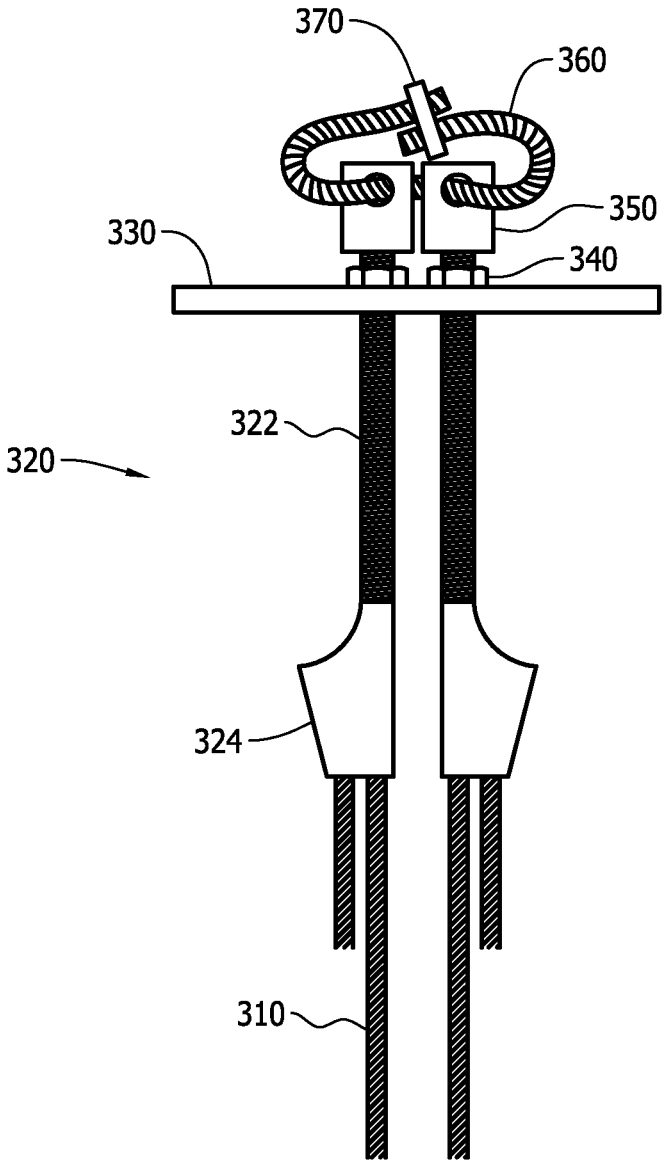
FIG. 3 shows a schematic of elevator cables, shackles, and an anti-rotation device according to an exemplary embodiment.

Embodiments of an anti-rotation device that may be safely and easily accessed will be described with reference to the accompanying drawings. FIG. 3 shows a schematic of elevator cables, shackles, and an anti-rotation device according to one exemplary embodiment.

In FIG. 3, a plurality of elevator cables 310 from which an elevator carriage or counterweight are suspended are received into cable shackles 320. In FIG. 3, two elevator cables 310 and two cable shackles 320 are shown for simplicity in explanation. However, in practice, more elevator cables 310 and cable shackles 324 may be provided, such as six or more.

The cable shackles each include a cable locking mechanism 324 through which the elevator cable 310 is reversed and wedged in order to lock the elevator cable 310 with respect to the cable shackle 320. The cable shackles 320 further include a threaded rod 322 that extends up through a hitch plate 330.

The shackle rods 322 are fixed into a predetermined position with a shackle base 340. The shackle base 340 may be a pair of locking nuts that fix a position of the threaded rod with the hitch plate 330. The shackle base 340 may further comprises a spring to absorb energy from the operation of the elevator.

Unlike the conventional anti-rotation device, the present embodiment includes a plurality of anti-rotation devices 350 that are each affixed to the top of one of the threaded rods 320. That is, in this embodiment, the anti-rotation devices 350 are disposed above the hitch plate 330 in a machine room and are not disposed in an elevator shaft. The anti-rotation devices 350 are configured such that an anti-rotation cable 360 is threaded through each of the anti-rotation devices 350. Ends of the anti-rotation cable 360 are joined together using, for example, a cable clamp 370.

Figure 1:
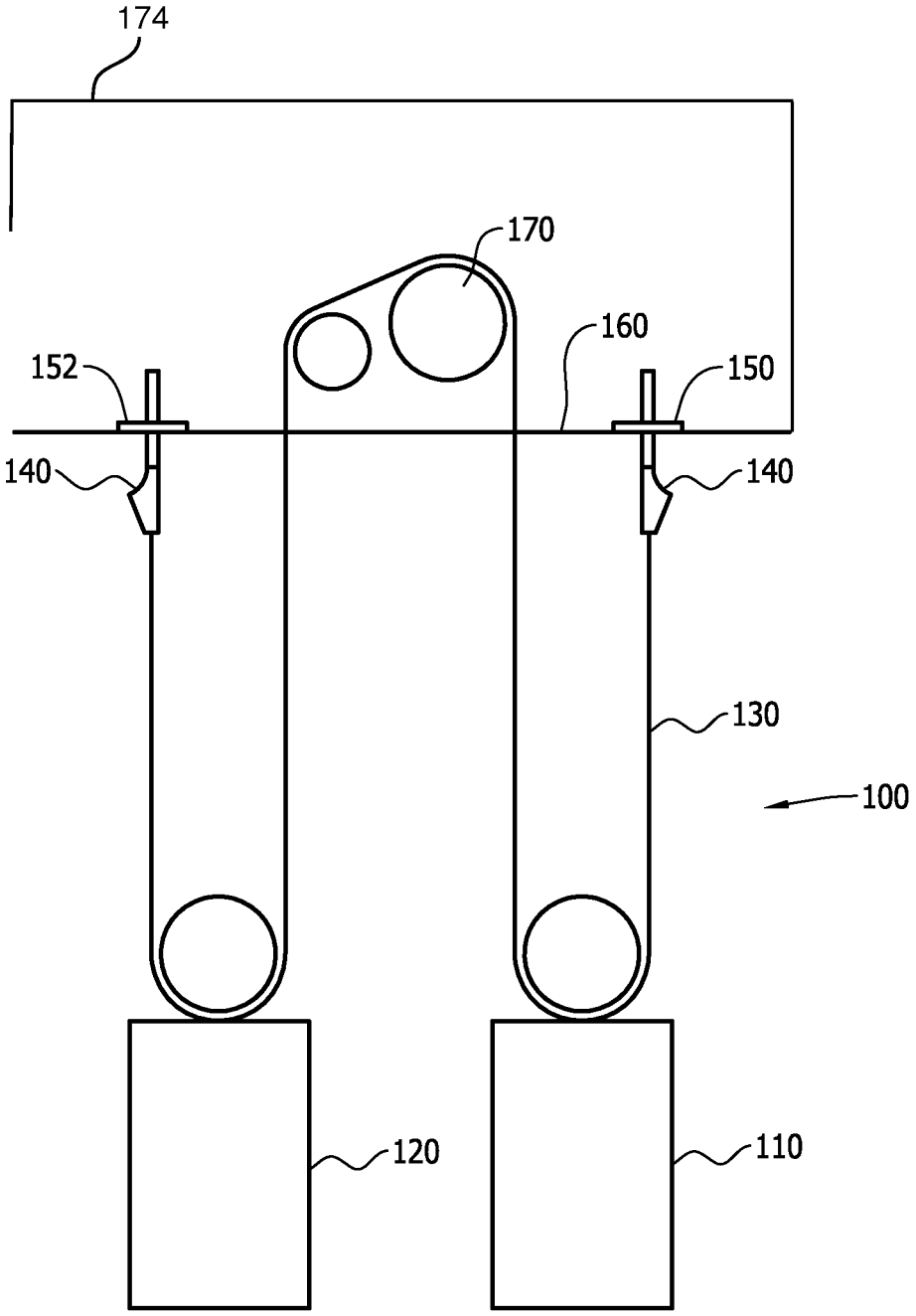
FIG. 1 (Prior Art)
FIG. 1 shows a schematic of a conventional 2:1 cable configuration for an elevator.
Figure 2:
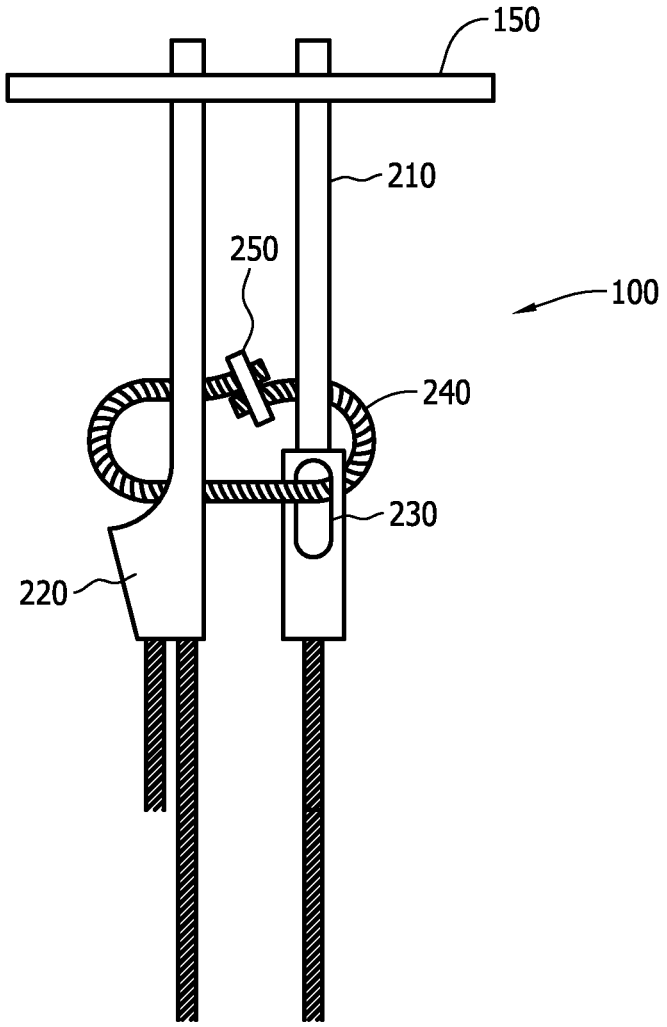
FIG. 2 (Prior Art)
FIG. 2 shows a schematic of a conventional anti-rotation device.

In operation, if one of the shackles 320 begins to rotate, the anti-rotation cable 360 will limit the rotation of the elevator cable 310 due to the anti-rotation cable being threaded through each of the anti-rotation devices 350. Furthermore, because the anti-rotation devices are attached to the top of the cable shackle 320 instead of the bottom, it is faster and safer to access by a maintenance person, compared to the prior art system, because the anti-rotation device 350 is in the mechanical room 174 (see FIG. 1) and not at the top of the elevator shaft. Also, because the anti-rotation devices 350 are on top of the cable shackles 320, the anti-rotation devices 350 are less likely to be crushed and/or pinched by the shackles 320 during use.

Figure 4:
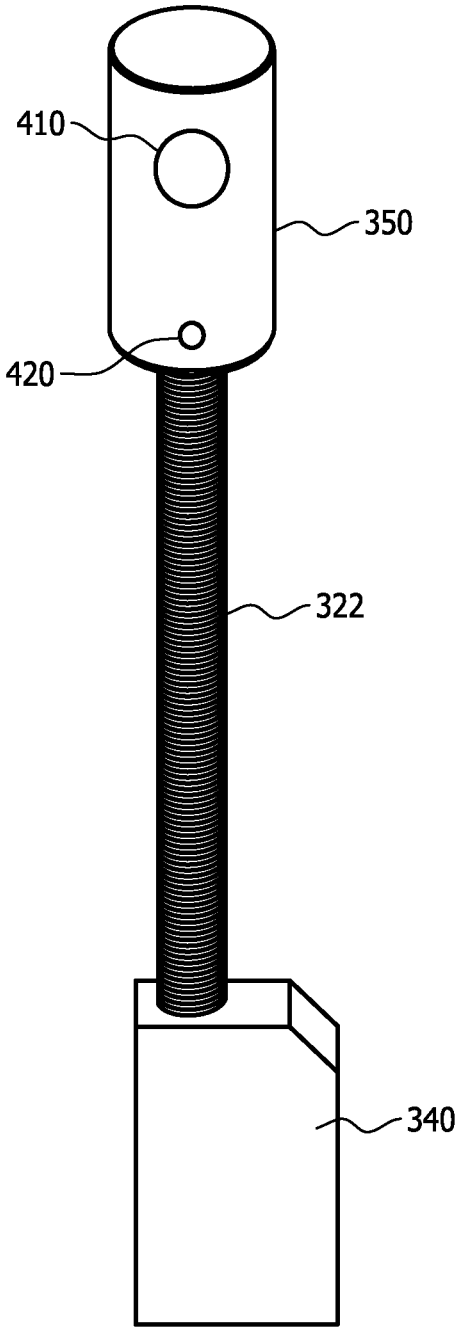
FIG. 4 shows an enlarged view of the cable shackle and anti-rotation device illustrated in FIG. 3.

FIG. 4 shows an enlarged view of the cable shackle and anti-rotation device illustrated in FIG. 3. As shown with more detail in FIG. 4, the anti-rotation device 350 is disposed on top of the threaded rod 322. The shackle base 340 is shown for perspective, but in use it is located below the floor of the elevator mechanical room in the elevator shaft. The anti-rotation device further includes a first aperture 410 and at least one second aperture 420 which will be described in further detail below. Although shown as round, it could be any shape, such as square, or multifaceted. It could also be any shape and the apertures 410 could be located on each side of the rod 322 if the shape of the anti-rotation device is altered.

Figure 5:
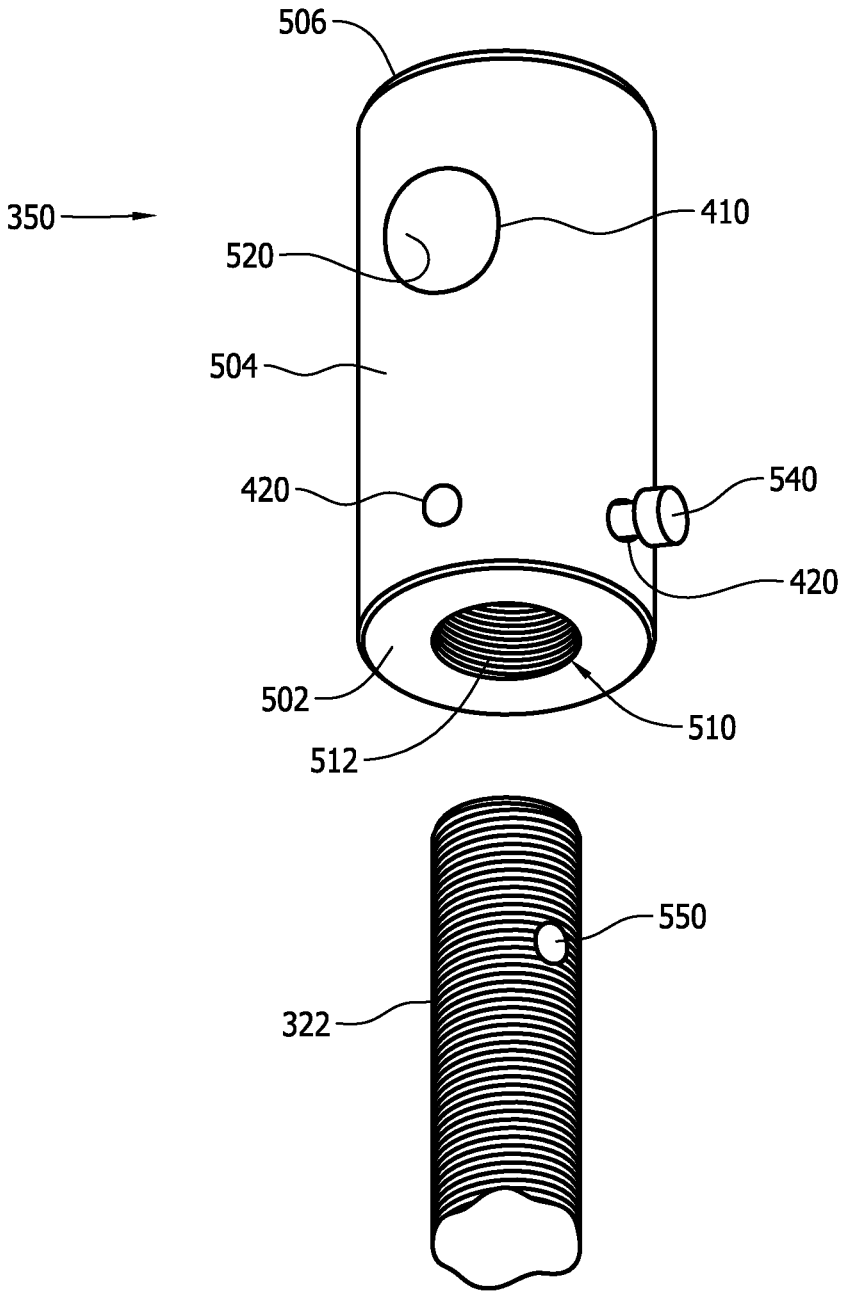
FIG. 5 shows an enlarged view of the anti-rotation device illustrated in FIGS. 3 and 4.

FIG. 5 shows an enlarged view of the anti-rotation device illustrated in FIGS. 3 and 4. In this embodiment, the anti-rotation device 350 is formed in a substantially cylindrical shape have a planar bottom end 502, a planer top end 506 and cylindrical body 504. The bottom end 502 includes a bore 510 that extends partially through the cylindrical body 504. The bore 510 is configured to receive the threaded rod 322 of the shackle 320. The bore 510 comprises an inner surface 512. The inner surface 512 may comprise threads to engage with the threaded rod 322. Alternatively, the inner surface 512 may be smooth and may simply slide over the threaded rod 322. This is but one possible configuration and other configurations and shapes are contemplated which do not depart from the invention as claimed below.

The first aperture 410 extends transversely through the cylindrical body 504 with respect to a central axis of the cylindrical body 504. The first aperture 410 is positioned in the cylindrical body above the bore 510 such that the bore 510 does not extend beyond the first aperture 410. In some embodiments, the bore 510 is configured such that it does not intersect the first aperture 410. The first aperture 410 has an inner surface 520 defining a cylindrical hole through the cylindrical body 504.

The first aperture 410 is configured to receive the anti-rotation cable 360 (shown in FIG. 3) that ties each of the anti-rotation devices 350 together to prevent rotation of the individual shackles 320. The inner surface 520 of the aperture 410 may be smooth to facilitate insertion and removal of the cable 370. Alternatively, the inner surface 520 may be configured so as to induce friction between the inner surface 520 and the cable 370 to better lock the cable in position during operation. Furthermore, if another device comprising threads is used to connect the anti-rotation devices together instead of the cable 370, the inner surface 520 may be configured to have threads.

As stated previously, the anti-rotation devices 350 comprise at least one second aperture 420. The at least one second aperture 420 is configured to extend transversely through the cylindrical body 504 with respect to the central axis. The at least one second aperture 420 is disposed within the cylindrical body 504 such that it intersects the bore 510.

The threaded rod 322 is configured to have a transverse hole 550 in a top portion thereof. Each anti-rotation device 350 further comprises a bolt 540 or other element that extends through a second aperture 420 and the transverse hole 550 of the threaded rod 322. The bolt may comprise threads at least on an end thereof such that a nut (not shown) may lock the bolt 540 in place, thereby securing the anti-rotation device 350 to the threaded rod 320. The nut, for example, may by a locking nut such as a nylock nut. The bolt 540 may be replaced with a pin, wire, cotter pin, screw, rod, or any other member to prevent rotation of the body 504 in relation to the rod 322.

More than one second aperture 420 may be provided for convenience in orienting the first aperture 410. For example, two second apertures 420 with connecting bores may be disposed so as to be perpendicular to each other to allow two different possible orientations of the first aperture 410 when the anti-rotation device 350 is fixed to the threaded rod 320 by the bolt 540.

The anti-rotation device is comprised of a sufficiently strong material to withstand the forces applied on it while preventing rotation of the shackles 320. In one embodiment, the anti-rotation device 350 may be made of steel, such as 1215 carbon solid round steel. In other embodiments the anti-rotation device is formed from other material. The dimensions of the anti-rotation device are not particularly limited, and are configured so at to be used with one or more standard shackles 320.

Other embodiments and modifications may be possible without departing from the scope of the invention. For example, while the anti-rotation device 350 describe above is cylindrical in shape, the anti-rotation device may be any suitable shape including square, hexagonal, octagonal, or rectangular. Further, while a bolt 540 is described above to secure the anti-rotation device 350 to the threaded rod 322, a number of other devices could be used including pins such as cotter pins, wire, cable, locks, etc. The connection between the anti-rotation device 350 and the threaded rod 322 may further be enhanced with an adhesive such as an epoxy resin.

As another example, the anti-rotation device 350 may have a threaded projection, instead of the bore 510, which is received into a corresponding bore in the end of the threaded rod 322. Further, a ring or other fixture may be attached to the top 504 of the anti-rotation device 350 in place of the first aperture 410 to receive the anti-rotation cable 360 or other fixing mechanism to prevent rotation of the individual shackles.

It should be noted that while the anti-rotation device is configured to be used with a cable to prevent rotation, a different type devices or elements could be used to interconnect the anti-rotation devices or the anti-rotation device could be connected to the based plate 152, 152 or other structure to prevent or reduce rotation.

In addition, although referred to as an anti-rotation devices, it is contemplated that there may be some rotation of the cable when the anti-rotation is installed, such a few degrees of movement in either the clockwise or anti-clockwise direction. However, a full 360 degrees of rotation is not possible and it is unlikely that even 180 degree or even 90 degrees of rotation may occur. The term anti-rotation should be understood to mean to resist rotation or prevent an entire revolution of rotation.

While various embodiments and alternatives have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An anti-rotation system for an elevator system that includes an elevator shaft, elevator suspension cables, and a mechanical room, the anti-rotation system comprising:

a plurality of elevator suspension cables;

a hitch plate disposed on a floor of the mechanical room and at a top of the elevator shaft;

a plurality of cable shackles, each cable shackle including a cable locking mechanism on a first end thereof configured to lock one of the elevator suspension cables and a threaded rod on a second end thereof configured to extend through the hitch plate from the elevator shaft to the mechanical room; and a plurality of anti-rotation devices, each anti-rotation device being fixed to the threaded rod of one of the plurality of cable shackles in the mechanical room, and each anti-rotation device being connected to at least one other anti-rotation device, whereby rotation of cable shackles is prevented, each anti-rotation device comprising:

a cylindrical body having a first end and a second end, the first end comprising a bore that extends partially through the cylindrical body, the bore being configured to receive the threaded rod; and a second aperture that extends through the cylindrical body in a direction perpendicular to an axis defined by the cylindrical body, the second aperture intersecting the bore, wherein the threaded rod includes a transverse hole, and the anti-rotation system further comprises a bolt that is configured to extend through the second aperture of the anti-rotation device and the transverse hole of the threaded rod.

2. The anti-rotation system according to claim 1, each anti-rotation device further comprising a first aperture that extends through the cylindrical body in a direction perpendicular to an axis defined by the cylindrical body.

3. The anti-rotation system according to claim 1, wherein the plurality of anti-rotation devices are tied together by an anti-rotation cable to thereby prevent rotation of the elevator suspension cables.

4. The anti-rotation system according to claim 3, wherein the anti-rotation cable is threaded through the first aperture of each of the anti-rotation devices, and ends of the anti-rotation cable are fixed together with a cable clamp.

5. An anti-rotation device for use with an elevator to prevent rotation of an elevator cable comprising:

a body with a first end and a second end;

a bore disposed in the first end of the body, the bore extending at least partially into the body;

a first aperture that extends through the body in a direction that is not parallel to an axis defined by the body;

at least one second aperture that extends through the body in a direction that is not parallel to the axis, the at least one second aperture intersecting the bore; and a bolt that extends through the at least one second aperture, the anti-rotation device being configured to be connected at least one other anti-rotation device via the first aperture, the connection between the anti-rotation device and the at least one other anti-rotation device preventing rotation of the anti-rotation device and the elevator wherein the bolt is at least partially threaded, and the bolt is configured to pass through a transverse hole in a threaded rod of an elevator cable shackle.

6. The anti-rotation device according to claim 5, wherein the first aperture has an inner surface that is smooth and is configured to receive a cable to connect the anti-rotation device with the at least one other anti-rotation device to prevent rotation relative between two anti-rotation devices.

7. The anti-rotation device according to claim 5, wherein the first aperture is threaded.

8. The anti-rotation device according to claim 5, wherein an inner surface of the bore is threaded whereby the bore is configured to be threaded onto a threaded rod of an elevator cable shackle.

9. The anti-rotation device according to claim 5, wherein an inner surface of the bore is smooth whereby the bore is configured to slide over and onto a threaded rod of an elevator cable shackle.

* * * * *